United States Patent [19]

Fabricius

[11] Patent Number: 4,984,404

[45] Date of Patent: Jan. 15, 1991

[54] RESILIENT FLOOR

[76] Inventor: Nils Fabricius, Kanotvägen 12, S-282 00 Tyringe, Sweden

[21] Appl. No.: 467,559

[22] Filed: Jan. 19, 1990

[30] Foreign Application Priority Data

Jan. 20, 1989 [SE] Sweden ..... 8900197

[51] Int. Cl.[5] ..... E06B 3/54

[52] U.S. Cl. ..... 52/480; 52/479; 52/506; 52/668

[58] Field of Search ..... 52/177, 273, 327, 479, 52/480, 481, 506, 507, 795, 660, 661, 664, 668, 669, 665

[56] References Cited

U.S. PATENT DOCUMENTS 2,846,931 8/1958 Priest ..... 52/669 X

FOREIGN PATENT DOCUMENTS 1907190 8/1970 Fed. Rep. of Germany ..... 52/480

*Primary Examiner*—John E. Murtagh
*Assistant Examiner*—Creighton Smith
*Attorney, Agent, or Firm*—Oblon, Spivak, McClelland, Maier & Neustadt

[57] ABSTRACT

A floor (1) with built-in resilience which makes it suitable for use in different sports both indoors and outdoors. The resilient floor is built up of mutually parallel studs (3) with recesses extending in the transverse direction. In the recesses, fillets (5) are arranged which extend beyond the upper side of the studs (3) and support surface planks (6). The recesses which are mirror-symmetrically arranged about a center axis transversely of the respective stud (3) have at least one inclined wall, the walls of the recesses intended for the same fillet (5) and positioned in adjoining studs (3) being inclined in the opposite direction. The fillets (5) are clamped in a wave-like manner in the associated recesses, in that they engage the inclined walls.

5 Claims, 2 Drawing Sheets

RESILIENT FLOOR

TITLE OF THE INVENTION

1. Field of the Invention

The present invention relates to a floor with built-in resilience which makes it suitable as a base for different sports both indoors and outdoors.

2. Discussion of the Background

When a person walks, jumps, runs or falls, the body is subjected to shocks of different strength which go through the entire skeleton up to the head. These shocks are absorbed to some extent by built-in shock absorbers, such as the two arches of the foot, the angle between foot and calf, the slightly bent knee-joint, the S-shaped spine as well as cartilage and discs as shock absorbers between all joints from the foot up to the head.

Precisely this variety of shock-absorbing organs confirms how essential it is to the body that the detrimental effect of the different shocks is reduced.

One way of helping the body in this shock absorption is to make the base softer. Streets, yards, roads and floors thus are not particularly body-friendly bases, especially in different sports which demand more of the base as compared to other everyday occupations. However, a lawn or, most preferably, a forest path well satisfies the demands that should be made on a base intended for sports.

On the other hand, such bases which are convenient for sports are disadvantageous since they are neither particularly durable nor seasonally independent. Besides it is an expensive business to maintain bases such as lawns and they cannot be used indoors.

Although there are different resilient floors for indoor use, they are not capable of satisfying all the demands that should be placed upon them. In many cases, the mass of the floor, which is to be set in motion to produce resilience, is too big, the speed at which the floor reacts is too low, the amplitude of the resilience is too low, for example when one tries to make a hard floor softer by laying a soft thin carpet thereon, and frequently the resilient mass responds to the pressure such that the return motion of the surface is short and gives a heavier shock in return as compared to the resilience of the downwardly moving surface.

SUMMARY OF THE INVENTION

The object of the present invention is to provide a resilient floor which is useful both indoors and outdoors and in which the amplitude and the frequency of oscillation of the resilience are adapted to the contact time of the running or jumping foot with the surface.

According to the invention, this object is achieved by means of a floor having the characteristic features stated in the appended claim 1.

By disposing, according to the invention, the fillet in an inclined manner in the recesses of the studs, only an edge portion of the fillet engages the recess bottom. Under a load, this edge portion is deformed and thus provides a first component of the desired resilience.

Since also the upper side of the fillet is inclined in the areas where the fillets are inserted in the recesses of the studs, surface planks resting on the fillets will in these areas also engage but an edge portion of the fillet, said edge portion being deformed when loaded and thus providing a second component of the desired resilience. In the portions between the studs, the upper sides of the fillets are however substantially planar and therefore not particularly inclined to be deformed. This is compensated for by the fact that under load, these portions of the fillets are instead subjected to a limited downward bending.

Both walls of the recesses can be inclined, the walls of the recesses in adjoining studs being inclined in opposite directions and being positionable directly opposite each other.

To increase the resilience, the bottom of the recesses can be pitched-roof-shaped, the roof ridge extending in the longitudinal direction of the studs and substantially in parallel with the upper side thereof, such that under load also this bottom portion is deformed, thereby providing a third component of the resilience.

Moreover, the lower side of the studs can be bevelled, so that, for the purpose of providing a further, fourth component of the resilience, only a longitudinal edge of the studs engages a support which preferably is formed of protective fillets extending in the transverse direction of the studs.

By wave-like bending and turning of the fillets of the floor structure in a mirror-symmetrical manner about a center axis transversely of the studs, and thus biassing said fillets and besides owing to the high built-in tensions, a relatively thin material can be used for the fillets and studs, which makes the mass of the floor small and consequently saves wood. The mirror-symmetrical structure serves to balance the forces which the fillets impart to the inclined walls of the recesses in each stud.

BRIEF DESCRIPTION OF THE DRAWINGS

A preferred embodiment of the invenion will be described in detail below with reference to the accompanying drawings in which.

DESCRIPTION OF THE PREFERRED EMBODIMENTS

Figure 1:
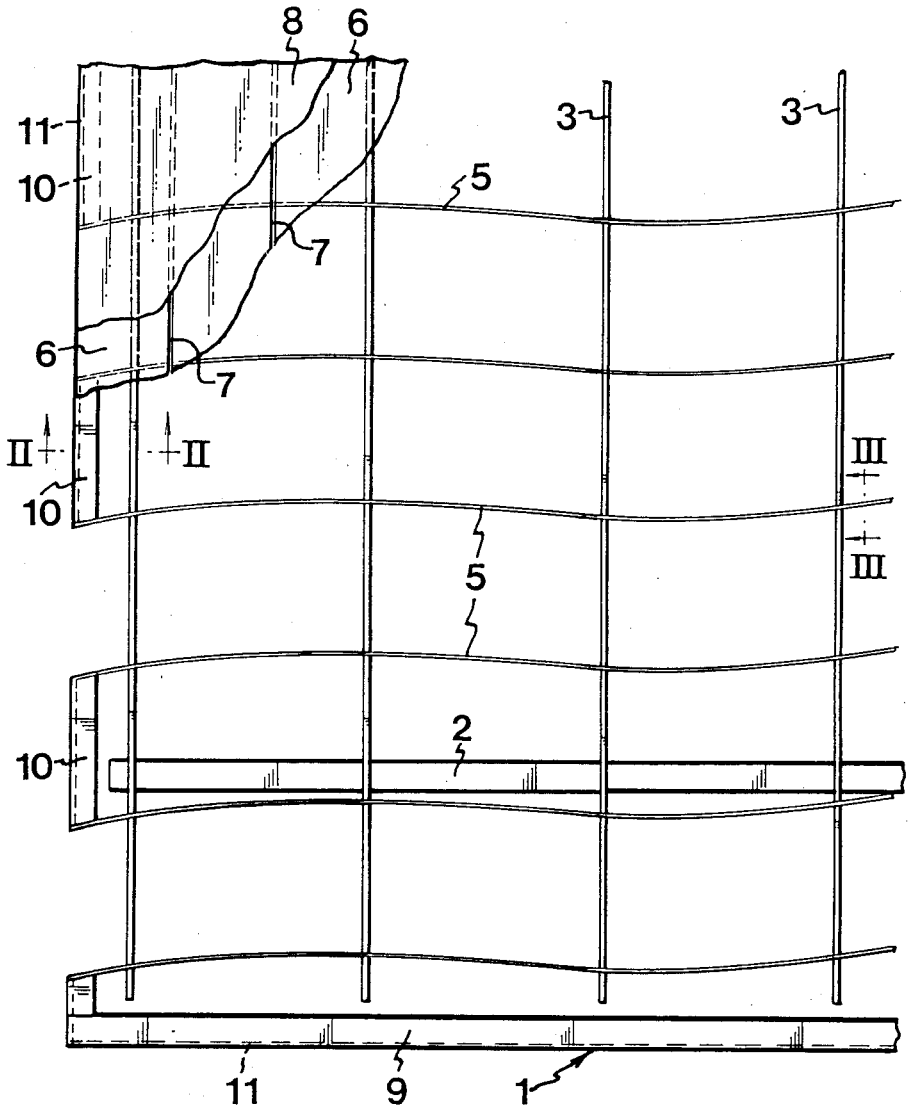
FIG. 1 is a top plan view of the floor with certain parts removed.
Figure 2:
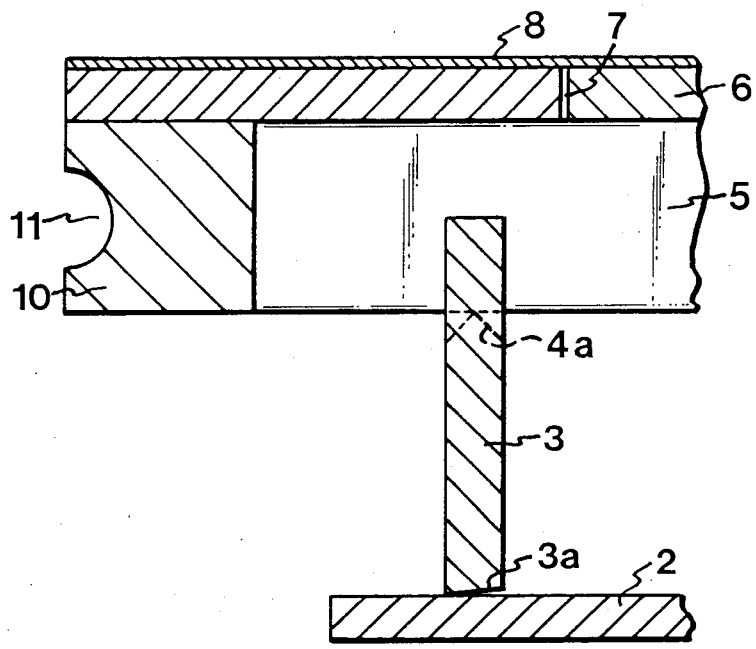
FIG. 2 is a cross-sectional view of part of the floor along the line II—II.
Figure 3:
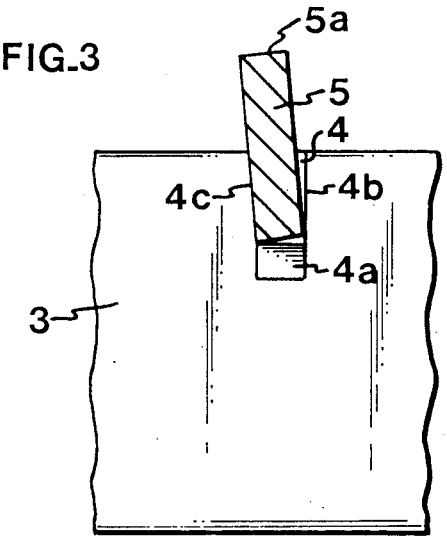
FIG. 3 is a cross-sectional view of part of the floor along the line III—III.

The floor 1 illustrated in the drawings can be designed as one of a number of identical, rectangular elements in a module system and is largely made of wood such as spruce or pine which is impregnated in some suitable manner for outdoor use.

The lowermost part of the structure comprises protective fillets 2 resting on a base which may consist of any flat surface or of e.g. studs, if the surface is not flat or drained. The protective fillets 2 which are of rectangular cross-section, are arranged lying on one of their flat sides in the transverse direction of the floor element, in parallel with each other and in a predetermined spaced-apart relationship and extend in one piece from one side of the floor element to the other.

On these protective fillets 2 and in the longitudinal direction of the floor element, studs 3 are positioned in a predetermined spaced-apart relationship and extend in one piece from one end of the floor element to the other, said studs also being of rectangular cross-section, except the lower narrow side 3*a* facing the protective fillets, which is bevelled such that only a longitudinal edge thereof engages the intersecting protective fillets 2. In the points of intersection, the studs 3 and the protective fillets 2 are joined together by some suitable fastening means, e.g. nails.

The upper side of the studs is formed with identical recesses extending transversely through the studs 3 and having a depth which approximately corresponds to one quarter of the height of the studs 3. They are arranged in a predetermined spaced-apart relationship over the entire length of the studs 3. The bottom 4*a* of each recess is formed as a pitched roof whose ridge extends in the longitudinal direction of the studs 3 and substantially in parallel with the upper side of the studs 3. The walls 4*b*, *c* of the recess 4 are flat, one wall, 4*b* extending at right angles to the upper side of the stud 3, while the other, 4*c*, is inclined, i.e. makes a smaller angle therewith, in such manner that the recess 4 widens upwardly. All studs 3 have the same number of recesses 4, and the recesses 4 of every second stud 3 are aligned with each other and have the inclined wall 4*c* on the same side, while the recesses 4 in adjoining studs 3 are mutually offset in the longitudinal direction of the stud 3 and have the inclined wall 4*c* on the opposite side.

Moreover, the recesses 4 are mirror-symmetrically arranged about a center axis transversely of the respective stud 3, all inclined walls 4*c* on one side of the centre axis being inclined in one direction and all inclined walls 4*c* on the other side of the centre axis being inclined in the opposite direction.

In the recesses 4, fillets 5 are mounted in the transverse direction of the floor and extend in one piece from one side edge of the floor element to the other. The fillets 5 which are of substantially rectangular cross-section are positioned on their edge and have a width corresponding to the bottom 4*a* of the recesses 4, the mutual displacement of the recesses 4 and their inclined walls 4*c* causing the fillets 5 which to approximately half their height are inserted in the recesses 4 of the studs 3 and which before being mounted are straight, to be on the one hand bent in a wave-like manner and turned and, on the other hand, to be inclined, at the portions inserted in the recesses 4, in the same direction as the inclined wall 4*c* of the respective recess 4 and to engage said wall, such that only an edge portion of the fillets engages the bottom 4*a* of the respective recess 4. The fillets 5 and the studs 3 are joined together by fastening means, e.g. nails, arranged at the recesses 4.

Surface planks 6 are disposed on the fillets 5 in the longitudinal direction of the floor, said planks having between themselves a small gap 7, thereby avoiding tensions if the planks 6 become wet. Owing to the inclined position of the fillets 5 in the recesses 4, the upper side 5*a* of the fillets 5 is inclined in an area above the recesses 4. As a result, the planks 6 rest in these areas on edges of said fillets. The planks 6 which extend in one piece from one end of the floor element to the other, are by suitable fastening means such as nails attached to the subjacent fillets 5. To protect the wood, the planks 6 are coated with suitable thin panels 8, e.g. fiberboard, whose surface can be treated so as to be non-slip also when it is wet.

Finally the floor element has along its outer edges a peripheral marginal portion for joining together a plurality of floor elements. At both ends of the floor element, the marginal portion is formed of a through stud 9 which is of substantially square cross-section and attached to the lower side of the surface planks 6. On the sides of the floor element, short members 10 of a similar stud are arranged in every second space between the fillets 5 extending up to the side edges of the floor element. The stud members 10 are attached to the lower side of the surface planks 6 and also to the end portions of the fillets 5. Both in the ends of the floor element and in its sides, the marginal portion has an outwardly facing groove 11 of e.g. semicircular cross-section. To connect two adjoining floor elements, a suitable rod is positioned in the groove 11, whereupon the floor elements are pressed together by a clamping means.

Obviously, numerous modifications and variations of the present invention are possible in light of the above teachings. It is therefore to be understood that within the scope of the appended claims, the invention may be practiced otherwise than as specifically described herein.

I claim:

1. A resilient floor comprising:

mutually parallel studs whose upper side has recesses extending in the transverse direction and having a bottom which is substantially parallel to the upper side of said studs; and fillets of substantially rectangular cross-section and mounted in said recesses, said fillets extending beyond the upper side of said studs and supporting surface planks wherein at least one wall of said said recesses is inclined in the longitudinal direction of said studs, the opposite wall of the recess intended for the same fillet and provided in the adjoining stud is inclined in the opposite direction, said fillet is clamped in a wave-like manner in the associated recesses in that it engages the inclined wall, and said recesses are mirror-symmetrically arranged about a center axis transversely of the respective stud.

2. The resilient floor as claimed in claim 1, wherein the recesses in adjoining studs are mutually offset such that the recesses of every second stud are positioned directly opposite each other.

3. The resilient floor as claimed in claim 1, wherein all inclined walls on one side of the center axis are inclined in one direction, and all inclined walls on the other side of said center axis are inclined in the opposite direction.

4. The resilient floor as claimed in claim 1, wherein the bottom of said recesses is pitched-roof-shaped, and the roof ridge extends in the longitudinal direction of the stud and substantially parallel with the upper side of the stud.

5. The resilient floor as claimed in claim 1, wherein the lower side of said studs is obliquely cut such that only a longitudinal edge of said studs engages a support formed of protective fillets extending in the transverse direction of said studs.

* * * * *